United States Patent [19]

Arakawa et al.

[11] Patent Number: 4,660,515

[45] Date of Patent: Apr. 28, 1987

[54] HEAD STRUCTURE FOR OHC TYPE INTERNAL COMBUSTION ENGINE

[75] Inventors: Tetsuo Arakawa; Masaaki Kato; Kazunori Watanabe, all of Saitama, Japan

[73] Assignee: Honda Giken Kogyo Kabushiki Kaisha, Tokyo, Japan

[21] Appl. No.: 758,152

[22] Filed: Jul. 23, 1985

[30] Foreign Application Priority Data

Jul. 25, 1984 [JP] Japan ..... 59-112626[U]

[51] Int. Cl.[4] ..... F01L 1/02

[52] U.S. Cl. ..... 123/90.27; 123/90.36; 123/90.6

[58] Field of Search ..... 123/90.36, 90.6, 90.27

[56] References Cited

U.S. PATENT DOCUMENTS

| | | | |
|---|---|---|---|
| 1,784,767 | 12/1930 | Summers | 123/90.44 |
| 2,749,888 | 6/1956 | Roos | 123/90.36 |
| 3,008,544 | 11/1961 | Krizman | 123/90.36 |
| 3,628,513 | 12/1971 | Grosseau | 123/90.36 |
| 4,086,887 | 5/1978 | Schoonover et al. | 123/90.4 |
| 4,537,166 | 8/1985 | Kimura et al. | 123/90.36 |

*Primary Examiner*—Ira S. Lazarus

*Attorney, Agent, or Firm*—Lyon & Lyon

[57] ABSTRACT

A cylinder head construction for an overhead cam type internal combustion engine using rocker arms for actuating the valves from the camshaft. A plurality of bearing portions or supports are spaced along the head and rotatably support the camshaft. A continuous rocker arm shaft extends from one end of the head to the other and is bolted to each of the bearing portions to reinforce the head and specifically the bearing portions.

7 Claims, 2 Drawing Figures

HEAD STRUCTURE FOR OHC TYPE INTERNAL COMBUSTION ENGINE

This invention relates to a structure for a head of an overhead cam ("OHC") type internal combustion engine and, in particular, to a structural improvement for increasing the strength and rigidity of the head without increasing its weight.

In every OHC type internal combustion engine the cylinder head assembly is rather complicated and is subjected to substantial stress as a result of the valve operating mechanism including valves, valve springs, rotating camshaft(s), rocker arm(s), rocker shaft(s), bearings and the like. The forces involved in transmitting the rotation of the camshaft into opening reciprocation of the valves against the closing force of the valve springs are substantial which requires rigid support for all the components to avoid premature wear and failure. One inherent structural weakness in most cylinder heads for OHC engines is in the bearing support for the camshaft, particularly when a valve operating mechanism design is employed where the camshaft is positioned above the rocker arms, since the camshaft is subject to substantial forces and is spaced from the rigid base of the cylinder head that forms the combustion chamber and valve supports.

It is an object of this invention to provide an improved cylinder head for an OHC engine wherein the strength and rigidity of the cylinder head are improved without an increase in weight or cost. It is a further object of the present invention to utilize the rocker shaft of the valve operating mechanism as a reinforcing member of the cam case portion of the cylinder head and thereby provide a structure of the cylinder head portion of the internal combustion engine which is lightweight and has the required rigidity.

A preferred embodiment of the present invention will be described with reference to the accompanying drawings, wherein.

Figure 1:
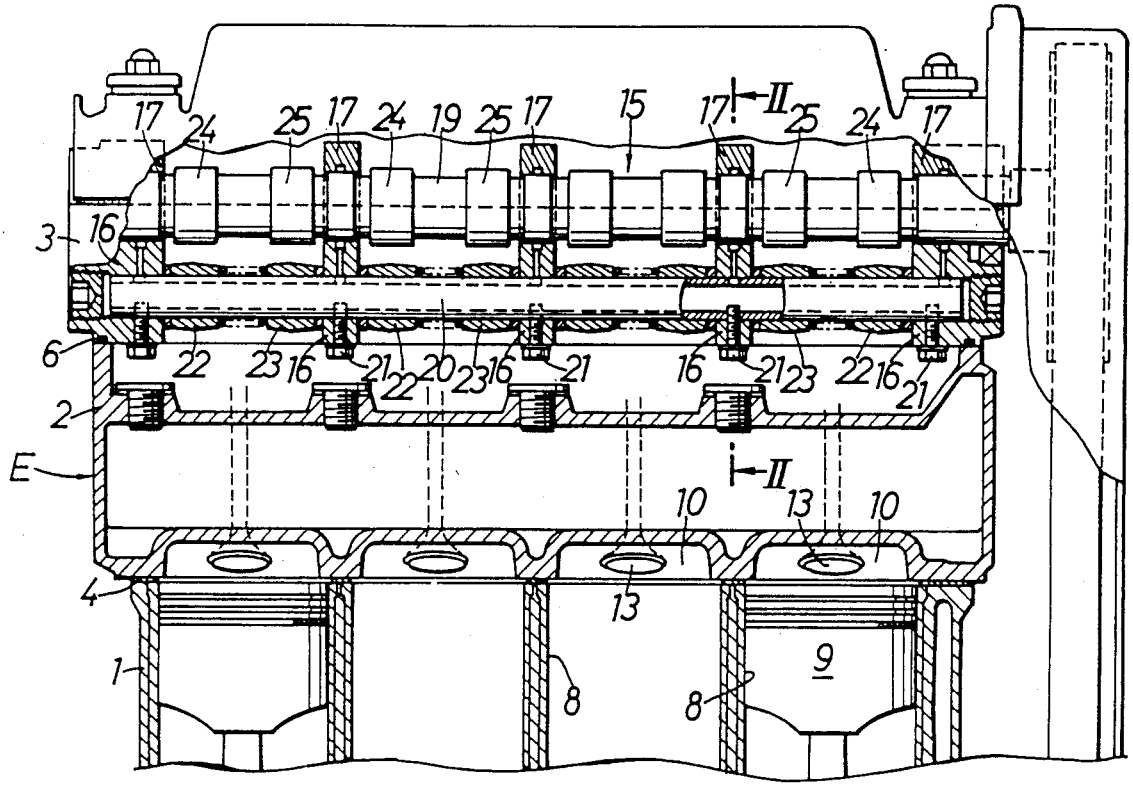
FIG. 1 is a side elevation view of the head portion of the OHC engine incorporating this invention with portions broken away and in section for clarity.
Figure 2:
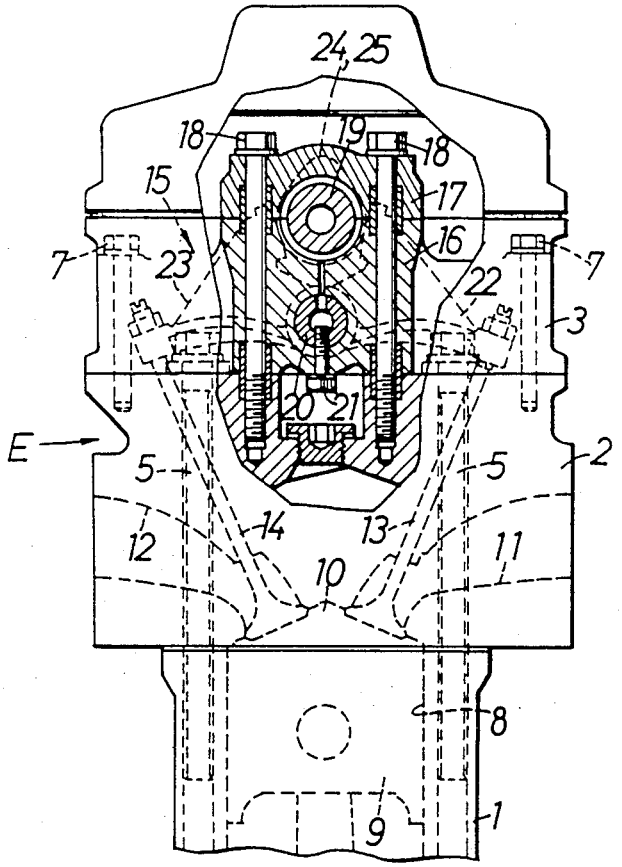
FIG. 2 is a sectional end view taken substantially on the line II—II in FIG. 1.

Referring now in detail to the drawings, a multiple-cylinder internal combustion engine E of an OHC type is provided with a cylinder block 1, cylinder head 2 and cam case 3. The cylinder head 2 is mounted on the cylinder block 1 by bolts 5 with a gasket 4 interposed therebetween. The cam case 3 is mounted on the cylinder head 2 by bolts 7 with an annular packing 6 interposed therebetween. In a conventional manner, the respective pistons 9 are slidably engaged in a plurality of cylinder bores 8 of the cylinder block 1. The cylinder head 2 is formed with combustion chambers 10, suction and exhaust ports 11 and 12, and suction and exhaust valves 13 and 14. The cam case 3 is provided with a valve operating mechanism, generally designated 15, for operating the suction and exhaust valves 13 and 14. The cam case 3 has a plurality of bearing portions 16 integrally formed therewith and spaced along the direction of arrangement of the cylinder bores 8. Bearing caps 17 are mounted on the respective bearing portions 16 by bolts 18. A valve operating camshaft 19 is rotatably supported by the bearing portions 16 and the bearing caps 17.

A rocker shaft 20 is positioned below and parallel to the valve operating camshaft 19 and passes through and is supported by the bearing portions 16 under the valve operating camshaft 19. A bolt 21 is inserted from the bottom surface of each bearing portion 16 through that bearing portion 16 and is threadedly screwed into the rocker shaft 20. Thus, the rocker shaft 20 is rigidly fixed to each of the bearing portions 16 by the bolts 21. Accordingly, the cam case 3 and the rocker shaft 20 are an integral structure, wherein the rocker shaft 20 serves as a reinforcing member for the cam case 3, thereby enhancing rigidity of the cam case 3, in particular, the bearing portions 16. The suction and exhaust rocker arms 22 and 23 are rockably supported on the rocker shaft 20 between each of the bearing portions 16. One end of each of the rocker arms 22 and 23 is in engagement with the valve operating cams 24 and 25, respectively, of the valve operating camshaft 19, while the other end of each rocker arm is connected to the suction or exhaust valves 13 and 14.

During operation of the engine E, the valve operating camshaft 19 rotates and the valve operating cams 24 and 25 rock the rocker arms 22 and 23 thereby opening and closing the suction and exhaust valves 13 and 14 at a predetermined timing. The substantial forces involved in opening the valves by means of the rocker arms are shared by the camhsaft 19 and rocker shaft 20 which in turn are transmitted directly to the bearing portions 16 or the cam case 3. As a result of the substantial reinforcement of the bearing portions 16 provided by the rigid rocker shaft 20 extending the length of the engine and bolted to each bearing portion 16, any significant flexing of the cam case 3 or bearing portions 16 is minimized or eliminated thereby enhancing the life and operation of the camshaft rocker arm bearings and greatly reducing vibrations in the valve operating mechanism 5. Further, since the rocker shaft 20 which must be provided is also used as a reinforcing member for the cam case 3, there is no increase in the weight of the cam case or the engine.

What is claimed:

1. A head structure for an OHC type internal combustion engine, comprising, a cam case fixed to a cylinder head for the engine, a plurality of bearing portions provided on said cam case for rotatably supporting a valve operating camshaft, a rocker shaft for rockably supporting valve rocker arms, and said rocker shaft being fixed to said bearing portions by bolts.

2. In a head structure for an internal combustion engine having an overhead camshaft, overhead valves, rocker arms for operating the valves from the camshaft, a rocker arm shaft for supporting the rocker arms, and bearing portions spaced along and integral with the head structure for supporting the camshaft and rocker arm, an improvement comprising, means for rigidly and releasably connecting the rocker arm shaft to each of the bearing portions, and wherein said means include a hole in each bearing portion for receiving the bolts, a threaded hole in the rocker arm shaft at each said hole in a bearing portion, and threaded bolts installed through said bearing portion holes and into said threaded holes for connecting the rocker arm shaft to each bearing portion.

3. The head structure of claim 2 wherein the rocker arm shaft is continuous from one end of the head structure to the other.

4. A head structure for an OHC type internal combustion engine, comprising, a cam case fixed to a cylinder head for the engine, a plurality of bearing portions provided on said cam case for rotatably supporting a valve operating camshaft, a first set of bolts for fixing the cam case on the cylinder head, a rocker shaft for rockably supporting valve rocker arms, and said rocker shaft being fixed to said bearing portions by a second set of bolts.

5. A head structure for an OHC type internal combustion engine comprising a cam case fixed to a cylinder head for the engine, a plurality of bearing portions provided on said cam case for rotatably supporting a valve operative camshaft, a first set of bolts for fixing the cam case on the cylinder head, such bolts being directed substantially downwardly from the cam case to the cylinder head, a rocker shaft for rockably supporting valve rocker arms, said rocker shaft being disposed below the cam shaft, and said rocker shaft being fixed to said bearing portions by a second set of bolts, such bolts being directed substantially upwards into the bearing portion and rocker shaft.

6. A head structure on claimed in claim 5 wherein the rocker shaft is located substantially vertically beneath the camshaft.

7. A head structure as claimed in claim 5 wherein the rocker shaft is a cylindrically extending wall and including threaded holes in one side of the wall of the rocker shaft, the second set of bolts engaging the threaded holes.

* * * * *